United States Patent [19]

Sando et al.

[11] 4,020,657

[45] May 3, 1977

[54] PRESSURE SEAL APPARATUS FOR A HIGH PRESSURE STEAMER

[75] Inventors: Yoshikazu Sando; Matsuo Minakata; Hiroshi Ishidoshiro; Masanobu Tomatsu, all of Wakayama; Isao Kamei, Kainan, all of Japan

[73] Assignee: Sando Iron Works Co., Ltd., Wakayama, Japan

[22] Filed: June 6, 1975

[21] Appl. No.: 584,262

[30] Foreign Application Priority Data

| | | |
|---|---|---|
| June 10, 1974 | Japan | 49-65816 |
| June 12, 1974 | Japan | 49-66946 |
| June 12, 1974 | Japan | 49-66947 |
| Dec. 25, 1974 | Japan | 50-4767 |

[52] U.S. Cl. ..... 68/5 E; 34/242

[51] Int. Cl.[2] ..... D06B 23/18

[58] Field of Search ..... 68/5 E; 34/242

[56] References Cited

UNITED STATES PATENTS 3,318,115 5/1967 Fujihashi ..... 68/5 E

*Primary Examiner*—Philip R. Coe

*Attorney, Agent, or Firm*—Toren, McGeady and Stanger

[57] ABSTRACT

In a pressure seal apparatus for a high pressure steamer, seal rolls form a nip in a roll seal mechanism mounted on the fiber products feed in and take out openings of a high pressure steamer vessel body. The roll seal mechanisms shield the inside of the vessel from external air when fiber products are fed in or taken out and are positioned on the upper planes of a seal block through which a fiber products passage extends. Different members can be combined with the seal rolls in forming the seal mechanism, such as intermediate rolls formed as water permeable hoses are inserted into concave parts provided on opposite sides of the fiber products passage through the seal block. In another embodiment an elastic sealing member is placed in contact with the seal block and the seal rolls. In still another embodiment a shielding valve is provided at one end of the fiber products passage for regulating vessel internal pressure and preventing sudden pressure leakage. As another alternative a vessel internal pressure detector and a pressure affording force regulating mechanism can be used or a fine adjustment mechanism can be employed for up and down movement of the seal block for stabilizing the pressure contacting force of the seal rolls and intermediate rolls to an appropriate value.

1 Claim, 8 Drawing Figures

PRESSURE SEAL APPARATUS FOR A HIGH PRESSURE STEAMER

BACKGROUND OF THE INVENTION

The present invention relates to a pressure seal apparatus installed at the fiber products take out and feed in openings of a high pressure steamer vessel body.

Heretofore, for this kind of pressure seal apparatus, the device installed at the fiber product feed in the opening side of a high pressure steamer vessel body is almost the same as that installed at the take out opening side. Its structure ordinarily included a pressure seal apparatus as used for shielding the inside of a vessel body from external air by means of a roll seal mechanism. The roll seal mechanism consists of a seal block installed at the fiber product feed in opening or at the take out opening, and includes left and right seal rolls rotating in contact with each other to form a nip lane when the fiber product is fed in or taken out, and a sealing member (for example intermediate rolls) intervening between the above mentioned seal rolls and the seal block.

However, one of the problems in such a pressure seal apparatus is that the pressure contact or close contact point between the above-mentioned sealing member and the pair of left and right seal rolls is positioned forming almost a right angle with the nip plane provided by the seal rolls against their axial center, therefore, it experiences large internal pressure over a wide area corresponding to one fourth of the circumferential plane of the seal roll. Acccordingly, it is necessary to have the above-mentioned seal rolls bear a large pressure load for preventing pressure seal leakage from the nip plane at the seal rolls, and leaving a fear of damaging fiber product passing through the nip plane.

Another problem when maintenance is done on a pressure seal apparatus as internal vessel pressure is directly borne by the seal apparatus, maintenance work can not be done unless the inside vessel pressure is returned to normal atmospheric pressure. Further, when there is something wrong in the pressure seal apparatus there is a fear of causing pressure leakage, such as blowing out high pressure vapour from vessel inside, which may cause a very dangerous condition for workers around the vessel, thus generating a serious safety problem, but no apparatus has yet been proposed for solving the problem.

In addition to these various problems, in a roll seal mechanism provided in conventional pressure seal apparatus, to afford a sure pressure seal by giving a prescribed pressing force over the nip plane formed by contact of the left and right rolls and the pressure contact plane between the seal rolls and the intermediate rolls, a seal block retaining the intermediate rolls in a rotatable manner is provided at fiber product take out and feed in openings so that the pressing force in a pressure contacting direction of the intermediate rolls onto the seal rolls is regulated by a hydraulic mechanism, but there is a shortcoming with such a very complicated structure.

SUMMARY OF THE INVENTION

An object of the present invention is to provide a pressure seal apparatus having a roll seal mechanism and an internal vessel pressure regulating mechanism for eliminating the above-mentioned shortcomings of conventional pressure seal apparatus.

In accordance with the present invention, a newly developed pressure seal apparatus is such that the function of the roll seal mechanism of fiber product take out opening so that the rotation of each of the left and right seal roll circumferential planes first contacts the sealing member, then faces the internal pressure side of vessel body and then rotates to form a nip plane, is utilized to reduce the portion of the circle of the seal roll circumferential plane facing the vessel internal pressure. The set-up is made so that the left and right seal lips are formed with sharply pointed ends, forming tangent lines to each of the left and right seal roll circumferential planes and extending in the direction of generation of the circumferential plane, wherein an end part of the lip in the rotating direction of the circumferential plane forms free end, and the opposite end from the sharply pointed end is elastically attached to the seal block, thereby the seal lips are placed in pressure contact with each of left and right seal roll circumferential planes by the vessel internal pressure.

The pressure seal apparatus of the present invention is made so that when the seal apparatus is placed in an abnormal state and a sudden and sharp pressure leakage of the high pressure vapour inside the vessel takes place, the fiber products passage through the seal block is quickly shut down. Further, in the initial stage of operation of the high pressure steamer, the fiber product passage is blocked as desired by placing the roll seal mechanism in an opened state, so that the above-mentioned operations of maintenance of apparatus and exchange of parts can be done easily.

The pressure seal apparatus according to the present invention is also made so that the pressure affording force given to the left and right seal rolls is in proportion to the vessel internal pressure, thus the rolls will have the prescribed nip pressure, as a result a constant nip width can be retained without applying unnecessary nip pressure over the seal rolls. Accordingly, the above-mentioned pressure seal apparatus is made so that the internal vessel pressure is detected and the pressure acting on the seal rolls in the nip direction is automatically increased depending on the internal vessel pressure detected.

Further, the pressure seal apparatus according to the present invention is made so that the seal block, which holds in a freely rotatable manner the intermediate rolls in pressure contacting with the seal rolls, can be finely adjusted by the operation of a worm gear mechanism in relation with its movement in the pressure contacting direction with the seal rolls, wherein the frictional assistance of the seal rolls and the intermediate rolls is reduced by providing the above-mentioned pressure contacting force at an appropriate level for preventing loss of power and enhancing operation efficiency by high speed operation.

BRIEF DESCRIPTION OF THE DRAWINGS

The drawings show examples of a pressure seal apparatus according to the present invention.

DESCRIPTION OF THE PREFERRED EMBODIMENTS

Figure 1:
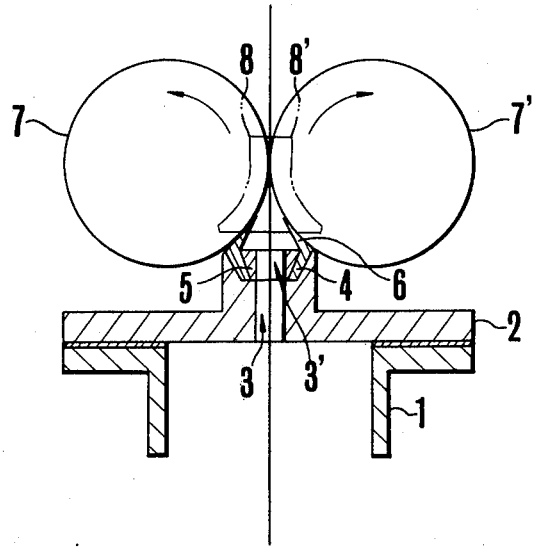
FIG. 1 is a front elevation view, partly in section, showing the set-up of important parts of a pressure seal apparatus at the fiber product take out opening end in Example 1.
Figure 2:
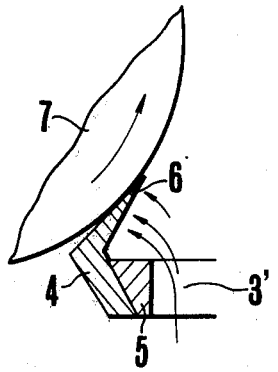
FIG. 2 is an enlarged partial view of FIG. 1, partly in section, illustrating a portion of the important parts.

Details of a pressure seal apparatus of the present invention will be explained based on the Examples shown in the drawings.

EXAMPLE 1

Figure 3:
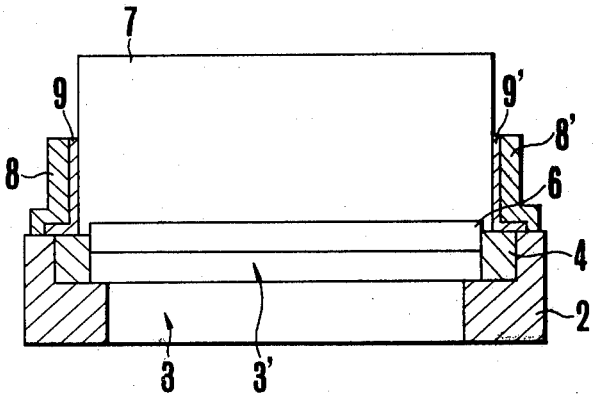
FIG. 3 is a side elevation of the apparatus shown in FIG. 1.
Figure 4:
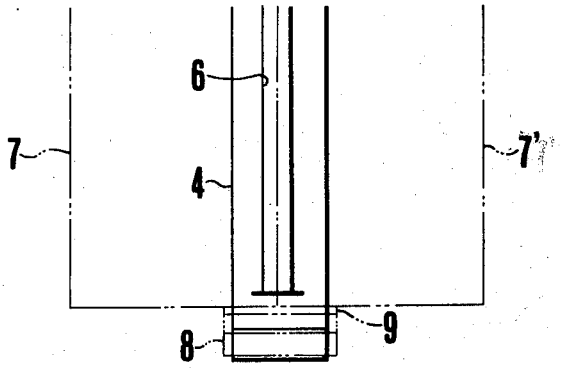
FIG. 4 is a partial plan view of a portion of the above-mentioned device.

In FIG. 1, 1 is a flange part at the fiber product take out opening of a high pressure steamer vessel body. 2 is a seal block fixed to the flange part 1 and having a fiber product passage 3 which passes through it. 4 is an elastic sealing member secured on the upper part of the seal block 2 by a fixing member 5 which has a fiber product take out passage 3′ aligned with the fiber product passage 3. The sharp pointed free end of the elastic sealing member 4 points and extends in the take out direction (shown by arrow) of the fiber products and forms a seal lip 6 at both sides of the fiber product take out route at the upper plane of the sealing member. 7, 7′ are a pair of left and right seal rolls in contact with one another and rotating in the fiber product take out direction. The seal rolls are provided in contact with the outside of the seal lip 6 extending to left and right. 8, 8′ are end plane sealing plates contacting the end planes of seal rolls 7, 7′ and the upper end flat plane of the elastic sealing member 4, respectively. 9, 9′ in FIG. 3 are lubricating sheets, such as Teflon, located between the end planes of the seal rolls 7, 7′ and the end plane sealing plates 8, 8′. The lubricating sheets have the function of pressure sealing and of rotation lubrication of the seal rolls 7, 7′.

Operation of the pressure seal apparatus at the fiber product take out end having the above-mentioned setup, is such that as the left and right seal rolls 7, 7′ rotate in the direction of the arrow shown in FIG. 1, the fiber product will be removed from the vessel body through the nip plane. In this case, the pressure seal in the seal rolls circumferential direction is made by the inner planes of left and right seal lips 6 forming sharp pointed ends sandwiching the fiber product take out route and bearing the inner pressure of the vessel, so that the seal lips 6 are in pressure contact with the circumferential planes of seal rolls 7, 7′ to form a pressure seal. Since the seal lips 6 are formed of elastic material in an integral structure with the elastic sealing member 4, the sealing state of the portion where the lips are in pressure contact with the circumferential planes of the seal rolls 7, 7′ by vessel internal pressure, exhibits a satisfactorily tight state, also as the sharp pointed free ends of the seal lips are directed to the rotating direction of the circumferential planes of the seal rolls 7, 7′ there will be no fear that they are bitten in by the rotation of the seal rolls 7, 7′. Furthermore, the circumferential direction pressure sealing position of the seal rolls 7, 7′ by the above-mentioned seal lips 6 will be in a positional relationship of about 45° with the nip plane formed by said seal rolls against their axial direction, therefore, the area of pressure receiving plane for the vessel inner pressure of the circumferential planes of the seal rolls 7, 7′ will be halved compared to that in the conventional pressure seal devices. As a result, the effect of internal pressure borne by the seal rolls 7, 7′ will be halved, and the pressure acting on the seal rolls required for forming nip plane, will be lowered, thus the power to drive the seal rolls 7, 7′ effectively can be small, furthermore, there will be the advantages that the operating cost will be lowered and the nip force on the fiber product in the nip plane will become small as the pressure affording force is lowered, preventing any unnecessary effect from working on the fiber product.

While the pressure contacting position of the pair of left and right seal rolls 7, 7′ and the seal lips 6 is set to be in a positional relationship of about 45° with the nip plane formed by the seal rolls 7, 7′ against their axial direction, said angle is not necessarily limited to 45°, instead, when it is made closer to the nip plane as long as no bad effect being given to fiber product, the area of the seal rolls 7, 7′ receiving pressure can be further reduced.

EXAMPLE 2

Figure 5:
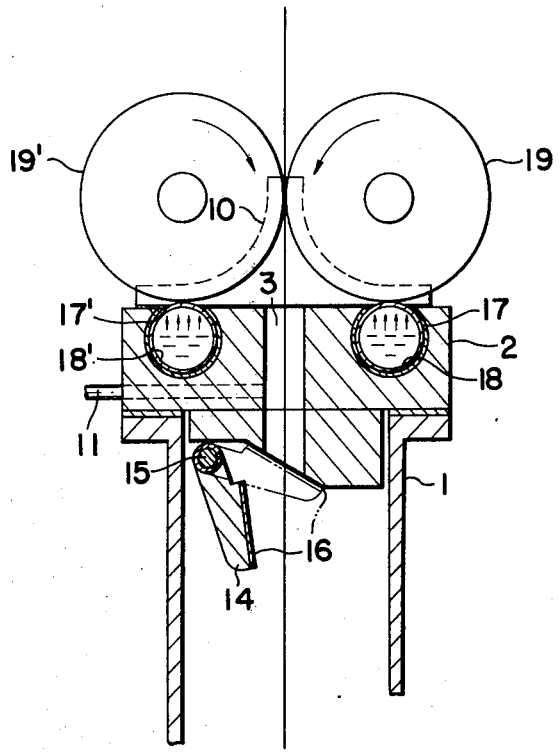
FIG. 5 is a vertical sectional view of the pressure seal apparatus in Example 2.

In a pressure seal apparatus shown in FIG. 5, 1 indicates a fiber product feed in opening flange part, while 2 shows a seal block fixed to the flange part 1 with a fiber product passage 3 extending through it. A shielding valve 14 is supported in a freely rotatable manner on an axle is provided along the fiber product passage 3 when it rotates into contacting with the side plane of the seal block 2 within vessel. Elastic material 16 is attached to the valve opening side of the shielding valve 14.

In the side of the seal block 2 outside of the vessel, concave grooves 18, 18′ are formed each containing a water permeable hose 17, 17′ provided on the opposite sides of the fiber product passage 3. When water is supplied under pressure into the water permeable hoses 17. 17′ a pair of left and right seal rolls 19, 19′ will be tightly contacted by the hoses 17, 17′ and the rolls rotate in contact with each other. End plane sealing plates 10 are provided in pressure contact with the opposite end planes of the seal rolls 19, 19′ with the external plane of the seal block 2, and also in tightly fitting contact with the water permeable hoses 17, 17′. An air pressure introduction tube extends through the seal block 2 into the fiber product passage 3, for flowing air into the fiber product passage.

Operation of the pressure seal apparatus is carried out with the shielding valve 14 kept in the non-active position shown by solid line in the drawing, as long as the inside of the pressure seal apparatus retains its normal state without any seal leakage during operation of a high pressure steamer.

When abnormal operation takes in the pressure seal apparatus and a sudden and violent leaking flow occurs which exceeds a preset pressure leakage value and flows to the pressure seal apparatus side beyond the fiber product passage of the seal block 2, the shielding valve 4 rotates into contact with the seal block 2 and closes the fiber product passage 3 as shown by the two dots and a bar line in the drawing.

After that, the shielding valve 14 remains in pressure contact with the seal block 2, pressed by high pressure within the vessel, thus preventing leakage of high pressure vapour from the vessel. After repairing any defective parts, the shielding valve may be opened manually or by transmission of pressurized air through the air pressure introduction tube 11 into the passage 3.

When the vapour within the vessel undergoes a sudden and sharp leakage outflow from the interior of the inside to the pressure seal apparatus side during operation of the high pressure steamer, the valve functions automatically in correspondence therewith, forming a safety device for leakage prevention.

If the shielding valve 14 is placed in a closed state when internal pressure of the vessel is still low during the initial stage of starting up a high pressure steamer until the internal pressure has risen to a prescribed level, or as necessary during operation, the nip plane part of the above-mentioned seal rolls can be opened, thus preliminary operation by a guide cloth becomes unnecessary, and the maintenance and the replacement of parts of the roll seal mechanism can be easily done.

EXAMPLE 3

Figure 6:
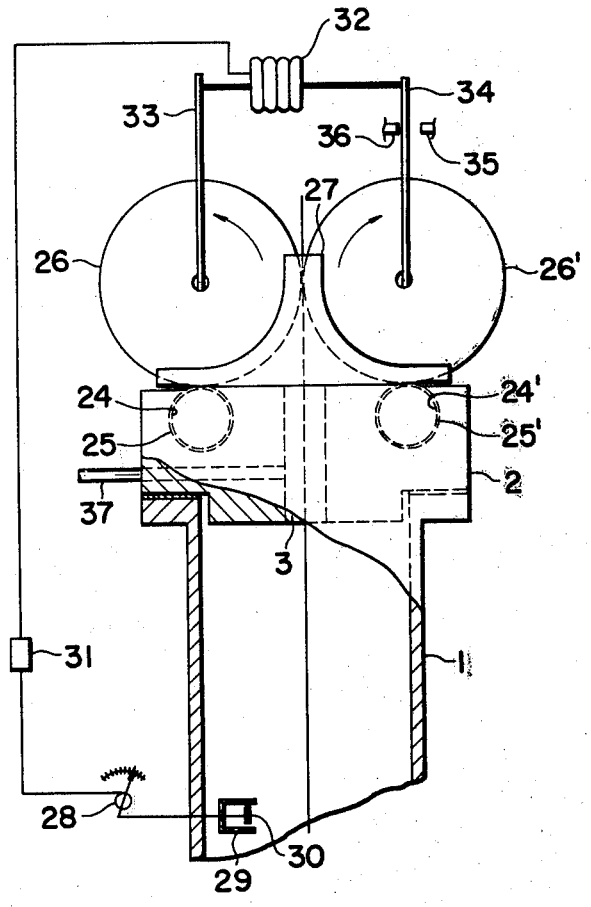
FIG. 6 is a vertical elevational view partly in section of the pressure seal apparatus in Example 3.

In the pressure seal apparatus shown in FIG. 6, a fiber product take out opening flange part 1, a seal block 2, having concave grooves 24, 24' located in opposite sides of a fiber product passage 3 are provided, while water permeable hoses 25, 25' are inserted in the concave grooves respectively in tightly fitting contact with the seal rolls 26, 26' when water is supplied under pressure. End plane sealing plates 27 contact the end planes of the seal rolls 26, 26' and the upper plane of the seal block to provide close contact with the water permeable hoses 25, 25'.

While the above-mentioned structure is similar to that shown in Example 2, in addition a vessel internal pressure detector 28 is provided in this example, with its input terminal connected within the vessel to a piston 30 sliding within a cylinder 29 with the piston exposed to a pressure corresponding to the vessel internal pressure, while its output terminal is connected to a rubber cylinder 32 through an amplifier 31. The rubber cylinder 32 has the function of regulating the pressure affording force in the nip direction of the seal rolls. One end of the rubber cylinder 32 is coupled with a fixed axle 33 in the nip direction of one seal roll 26, while its other end is coupled with a pressure affording force regulating axle 34 in nip direction supporting the other seal roll 26'. Located on the opposite sides of the regulating axle, 34 are a positioning stopper 35 for limiting the extent of regulation and a nip width restricting stopper 36. An air pressure introduction tube is connected to the fiber product passage 3 so that a gas such as air can be supplied under pressure, to said passage 3.

In such a pressure seal apparatus, when internal pressure in the vessel is small, the pressure affording force in the nip direction of the seal roll 26' is made small, then as the internal pressure increases, the rubber cylinder 32 having no internal resistance shifts the pressure affording force regulating axle 34 by the action of the vessle internal pressure detector 28 which detects any rise in the internal pressure, thus the pressure affording force in the nip direction of the seal roll is increased. Therefore, the nip pressure generated at the seal rolls, 26' can be always retained at constant value as the pressure affording force in the nip direction of the seal roll 26' increases along with any rise of the internal pressure in the vessel. Thus, no unnecessarily high nip pressure will be generated when internal pressure in the vessel is low, compared to a conventional pressure seal apparatus in which a constant pressure affording force in the nip direction is not in proportion with internal pressure. As a result, no unnecessary effect will be given to the fiber products passing through the nip part, such as deterioration of quality, and such apparatus has the advantage of extending the operating lifetime of the seal rolls 26, 26'.

EXAMPLE 4

Figure 8:
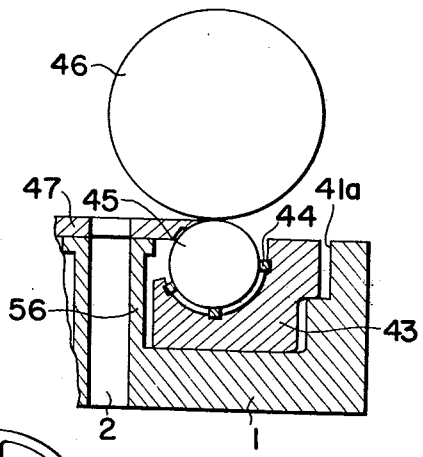
FIG. 8 is a front elevational view, partly in section, of the apparatus shown in FIG. 7.
Figure 7:
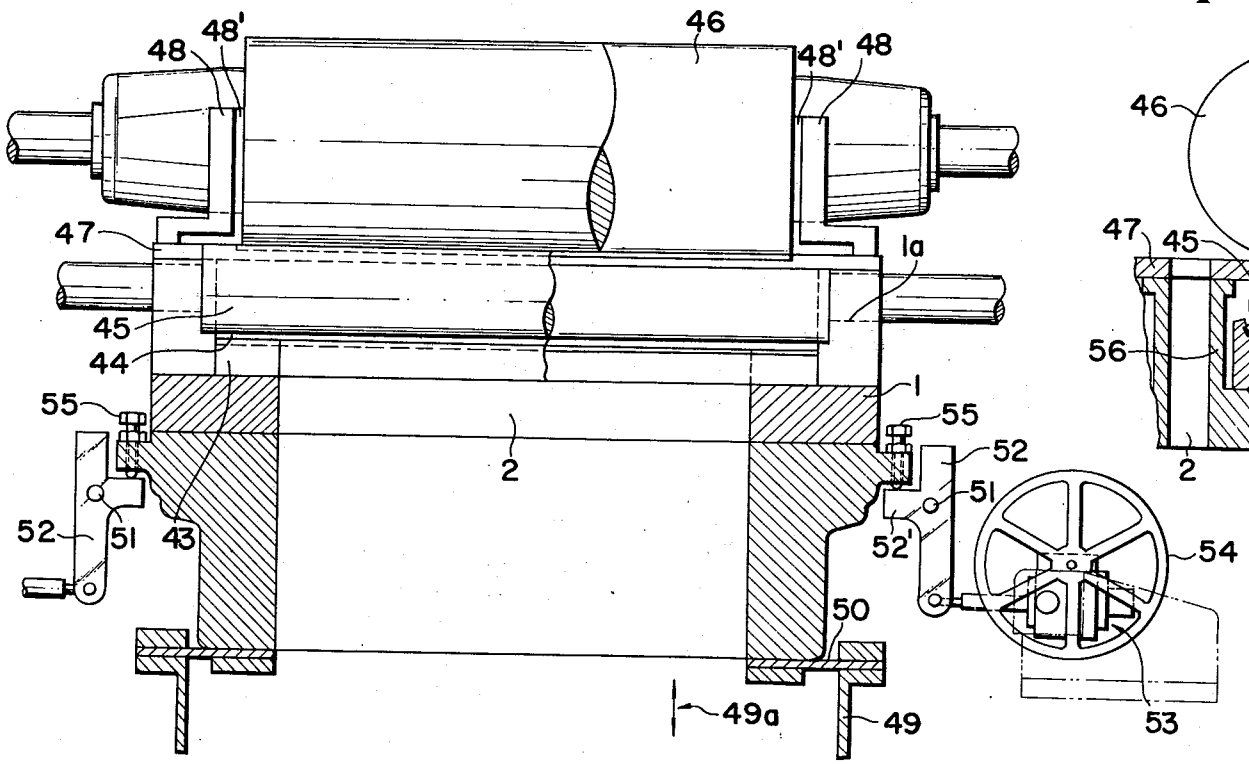
FIG. 7 is a side elevational view, partly in section, of the roll seal device in Example 4.

In the pressure seal apparatus shown in FIG. 7 and FIG. 8, an intermediate roll is rotatably supported by roll holders 44 at receiving stands provided within a concave part 41*a* opposingly provided at left and right of a fiber product passage 2 which is located in and extending through a seal block 1. Further, seal rolls 46 are contacted under pressure by the upper parts of intermediate rolls respectively, wherein the seal block (1) and the intermediate rolls 45 can shift integrally with the seal rolls 46 in the direction of their pressure contact. Flat plane seal liners 47 are installed over the fiber product passage (2) of the seal block 1 and their lip parts are in close contact with the circumferential plane of the intermediate rolls (45) along the direction of their generation. End plane sealing plates 48 are in close contact with the end planes of the seal rolls 46 and with the circumferential planes of the intermediate rolls 5, respectively, and include lubricating sheets which are sandwiched between the end planes and circumferential planes and the end plane sealing plates 48.

In order for the seal block 1 to shift up and down, its lower end part is connected through a flexible body 50 to a high pressure steamer 49 having a fiber product take out and feed in opening. The seal block 1 is coupled to a worm gear mechanism 53 through linking plates 52 which can be rotated by axles, wherein handles 54 are provided on the worm gear mechanisms 53 to adjust fine movement in the up and down direction of the seal block. Bolts 55 for adjusting the initial position of the seal block 1 protrude upwardly from the external circumferential plane of the seal block 1, and the forward ends of the bolts 55 are checked by protruding edges of the linking plates 12.

The function of the pressure seal apparatus of Example 4 is such that as the handle 54 is operated the worm gear mechanisms 53 are activated and the seal block can be finely adjusted in the up and down direction by axial rotation of the linking plate 52. Then the pressure contacting force of the seal rolls and the intermediate rolls 45 is adjusted to a suitable and constant value, whereby excessive pressure contacting force can be avoided. Therefore, unnecessary frictional resistance at the time of roll rotation can be reduced while power loss is also reduced effecting a saving, and the rotation of rolls becomes smoother, allowing remarkably higher speed operation over that of conventional apparatus. Also the processing time of the fiber product can be shortened by high speed operation, thus processing at higher temperature and higher humidity can be performed.

As has been explained above, any one of the examples of a pressure seal apparatus fixed to the fiber product take out and feed in openings of a high pressure steamer vessel body, according to the present invention, eliminates various shortcomings generated in conventional apparatus, and compared with similar apparatus of a conventional type, it enhances operating efficiency and processing effects with no fear of deterioration in the quality of fiber products by processing, with the further advantages of extended operating life of apparatus parts and reduction in handling expenses.

What is claimed is:

1. A pressure seal apparatus for a high pressure steamer, comprising a high pressure vessel body having a feed-in opening and a take-out opening for passing a fiber product into and out of said vessel body, a seal block fixed to each of said feed-in opening and take-out opening and forming an upwardly extending passage therethrough, said passage being rectangular in horizontal section with two long sides and two short sides, the upper ends of the long sides of said passage through said seal block being recessed outwardly, an elastic sealing member fitted into the recessed upper ends of said seal block and having an upper part projecting upwardly above the upper end of said seal block, a fixing member removably located within the recessed upper end of said sealing block inwardly of said sealing member and removably securing said sealing member to said seal block, said fixing member having inner surfaces defining a continuation of the passage through said seal block, a pair of rotatable seal rolls positioned above said seal block and disposed in contact with one another to form a nip aligned above the passage through said seal block and fixing member, the axis of said seal rolls extending in generally parallel relation with the long sides of said passage, the upper part of said sealing member forming a sealing lip along each long side of said passage and said sealing member and having a first surface facing inwardly toward the upward projection of said passage and an oppositely directed second surface with said second surface disposed in surface contact with the circumferential surface of the adjacent said seal roll, said first and second surfaces of said upward part of aid sealing member being disposed in spaced relation at the upper end of said seal block and tapering inwardly toward one another in the upward direction therefrom and terminating in a sharp pointed free end spaced above the upward end of the said seal block and pointing in the direction out of said vessel body, an end seal assembly located above each short end of said passage and disposed in pressure contact with each of the opposite transverse ends of said seal rolls and with the upper portion of said sealing lips of said sealing member, each said seal assembly comprises an end plane sealing plate and a lubricating sheet with said end plane sealing plate pressing said lubricating sheet against the transverse ends of said seal rolls and said end plane sealing plate disposed in pressure contact with the upper transverse ends of said sealing lips.

* * * * *